US008406672B2

(12) United States Patent
Tyagi

(10) Patent No.: US 8,406,672 B2
(45) Date of Patent: Mar. 26, 2013

(54) BENDING RECEIVER USING HEAT-SHRINKABLE TONER

(75) Inventor: Dinesh Tyagi, Fairport, NY (US)

(73) Assignee: Eastman Kodak Company, Rochester, NY (US)

( * ) Notice: Subject to any disclaimer, the term of this patent is extended or adjusted under 35 U.S.C. 154(b) by 399 days.

(21) Appl. No.: 12/845,789

(22) Filed: Jul. 29, 2010

(65) Prior Publication Data

US 2012/0027481 A1 Feb. 2, 2012

(51) Int. Cl.
*G03G 15/20* (2006.01)
*G03G 15/00* (2006.01)

(52) U.S. Cl. ..... 399/341; 399/411

(58) Field of Classification Search ..... 399/341, 399/381, 407, 409, 411; 430/124.13
See application file for complete search history.

(56) References Cited

U.S. PATENT DOCUMENTS

| | | | | |
|---|---|---|---|---|
| 3,694,359 | A | 9/1972 | Merrill | |
| 3,893,935 | A | 7/1975 | Jadwin et al. | |
| 4,079,014 | A | 3/1978 | Burness et al. | |
| 4,323,634 | A | 4/1982 | Jadwin | |
| 4,394,430 | A | 7/1983 | Jadwin et al. | |
| 4,624,907 | A | 11/1986 | Niimura et al. | |
| 4,683,188 | A | 7/1987 | Suzuki et al. | |
| 4,780,553 | A | 10/1988 | Suzuki et al. | |
| 4,814,250 | A | 3/1989 | Kwarta et al. | |
| 4,834,920 | A | 5/1989 | Bugner et al. | |
| 4,840,864 | A | 6/1989 | Bugner et al. | |
| 5,830,571 | A | 11/1998 | Mann et al. | |
| 6,053,403 | A | 4/2000 | Cai | |
| 6,329,113 | B1 | 12/2001 | Bourdelais | |
| 6,608,641 | B1 | 8/2003 | Alexandrovich et al. | |
| 7,654,638 | B2 | 2/2010 | Silverbrook | |
| 2006/0133870 | A1 | 6/2006 | Ng | |
| 2009/0190959 | A1 | 7/2009 | Kikushima | |
| 2010/0015421 | A1 | 1/2010 | Tyagi et al. | |
| 2011/0269612 | A1 * | 11/2011 | Tombs et al. | 493/320 |

FOREIGN PATENT DOCUMENTS

| | | |
|---|---|---|
| GB | 1420834 | 5/1972 |
| GB | 1501065 | 7/1975 |

OTHER PUBLICATIONS

P7400 Autofolder, Martin Yale Industries web site: http://www.martinyale.com/product_details.aspx?SKU=Martin%20Yale%20P7400&ReturnURL=%2fproduct_listing.aspx%3fCategory%3dd15cdba3-f886-4d69-84f9-cbfcaccee83c%26page%3d1%26pagesize%3d10%26text%3dp7400%26EPCString1%3d%26EPCString2%3d%26EPCString3%3d.

* cited by examiner

*Primary Examiner* — Walter L Lindsay, Jr.
*Assistant Examiner* — Billy J Lactaoen
(74) *Attorney, Agent, or Firm* — Christopher J. White

(57) ABSTRACT

Apparatus for bending a receiver having an image side and a non-image side in a bend area having a bend axis. Toner is deposited on the image side of the receiver in the bend area. A device compresses the deposited toner to form a toner film using a heated anvil and a selectively-cooled quencher that stretch and cooled the toner in the bend area below its Tg to form a toner film disposed over the surface of the receiver in the bend area. A heater reheats the bend area of the receiver so that temperature of the toner in the bend area rises above its Tg, so that the toner contracts and the receiver bends at the bend axis.

16 Claims, 4 Drawing Sheets

BENDING RECEIVER USING HEAT-SHRINKABLE TONER

CROSS-REFERENCE TO RELATED APPLICATIONS

Reference is made to commonly assigned, co-pending U.S. patent application Ser. No. 12/845,810, filed concurrently herewith entitled "Bending Receiver Using Heat-Shrinkable Film", by Dinesh Tyagi, the disclosure of which is incorporated by reference herein.

FIELD OF THE INVENTION

This invention pertains to the field of electrophotographic printing and more particularly to finishing prints by bending or folding.

BACKGROUND OF THE INVENTION

Electrophotography is a useful process for printing images on a receiver (or "imaging substrate"), such as a piece or sheet of paper or another planar medium, glass, fabric, metal, or other objects as will be described below. In this process, an electrostatic latent image is formed on a photoreceptor by uniformly charging the photoreceptor and then discharging selected areas of the uniform charge to yield an electrostatic charge pattern corresponding to the desired image (a "latent image").

After the latent image is formed, charged toner particles are brought into the vicinity of the photoreceptor and are attracted to the latent image to develop the latent image into a visible image. Note that the visible image may not be visible to the naked eye depending on the composition of the toner particles (e.g. clear toner).

After the latent image is developed into a visible image on the photoreceptor, a suitable receiver is brought into juxtaposition with the visible image. A suitable electric field is applied to transfer the toner particles of the visible image to the receiver to form the desired print image on the receiver. The imaging process is typically repeated many times with reusable photoreceptors.

The receiver is then removed from its operative association with the photoreceptor and subjected to heat or pressure to permanently fix ("fuse") the print image to the receiver. Plural print images, e.g. of separations of different colors, are overlaid on one receiver before fusing to form a multi-color print image on the receiver.

Electrophotographic (EP) printers typically transport the receiver past the photoreceptor to form the print image. The direction of travel of the receiver is referred to as the slow-scan, process, or in-track direction. This is typically the vertical (Y) direction of a portrait-oriented receiver. The direction perpendicular to the slow-scan direction is referred to as the fast-scan, cross-process, or cross-track direction, and is typically the horizontal (X) direction of a portrait-oriented receiver. "Scan" does not imply that any components are moving or scanning across the receiver; the terminology is conventional in the art.

Customers of print jobs can require finishing steps for their jobs. These steps include, for example, folding printed or blank sheets, cutting sheets, trimming sheets to size and shape, cutting specialty shapes into the edges or interior of a sheet, forming multiple sheets into bound signatures or booklets, binding individual pages or signatures into books, and fastening covers to books by e.g. stapling, saddle-stitching, or gluing. Signature production requires folding a large printed sheet and cutting the folded stack so that the resulting cut pages are in sequential order. Furthermore, unlike offset presses which run a large number of copies of a single print job, digital printers can produce small numbers of copies of a job, requiring more frequent changes to the finishing sequence. In some cases, each printed page must be finished individually. With regards to folding, conventional folders, such as the RAPIDFOLD P7400 Desktop AutoFolder by MARTIN YALE, cannot finish each page individually without manual intervention.

There is a need, therefore, for an improved way of folding or bending printed sheets that permits each sheet to be folded or bent differently.

SUMMARY OF THE INVENTION

This need is met by depositing toner in an area to be folded or bent and compressing the toner so that it exhibits heat-shrinkage. Toner can be deposited in one or more different location(s) on each sheet, and heating the sheet will cause bending where the heat-shrinking toner is located.

According to the present invention, therefore, there is provided apparatus for bending a receiver having an image side and a non-image side in a bend area, the bend area including a bend axis, comprising:

a) an electrophotographic print engine for depositing toner on the image side of the receiver in the bend area;

b) a device for compressing the deposited toner to form a toner film, the compressing device including:

i) a heated anvil disposed adjacent to the non-image side of the receiver, so that the temperature of the toner in the bend area rises above its Tg; and ii) a quencher disposed adjacent to the image side of the receiver opposite the anvil and operative to selectively press the bend area of the receiver and the toner therein against the anvil after the temperature of the toner in the bend area rises above its Tg, the quencher being cooled, so that the toner in the bend area is stretched and cooled below its Tg by the quencher to form the toner film disposed over the surface of the receiver in the bend area; and c) a heater for reheating the bend area of the receiver so that temperature of the toner in the bend area rises above its Tg, so that the toner contracts and the receiver bends at the bend axis.

An advantage of this invention is that it provides paper bends along arbitrary configurations limited only by the resolution with which toner can be deposited. Toner to bend the paper can be deposited at the time of printing, but the printed receivers remain unbent until necessary. Preprinted receivers can be shipped flat, saving space and cost, and bent or folded at the recipient's site rather than at the printer's site. In various embodiments, bends can be produced inexpensively and without requiring capital investment in folding equipment. Using toner to bend the paper does not require any additional materials, so it the reduces cost of providing bends.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

Figure 1:
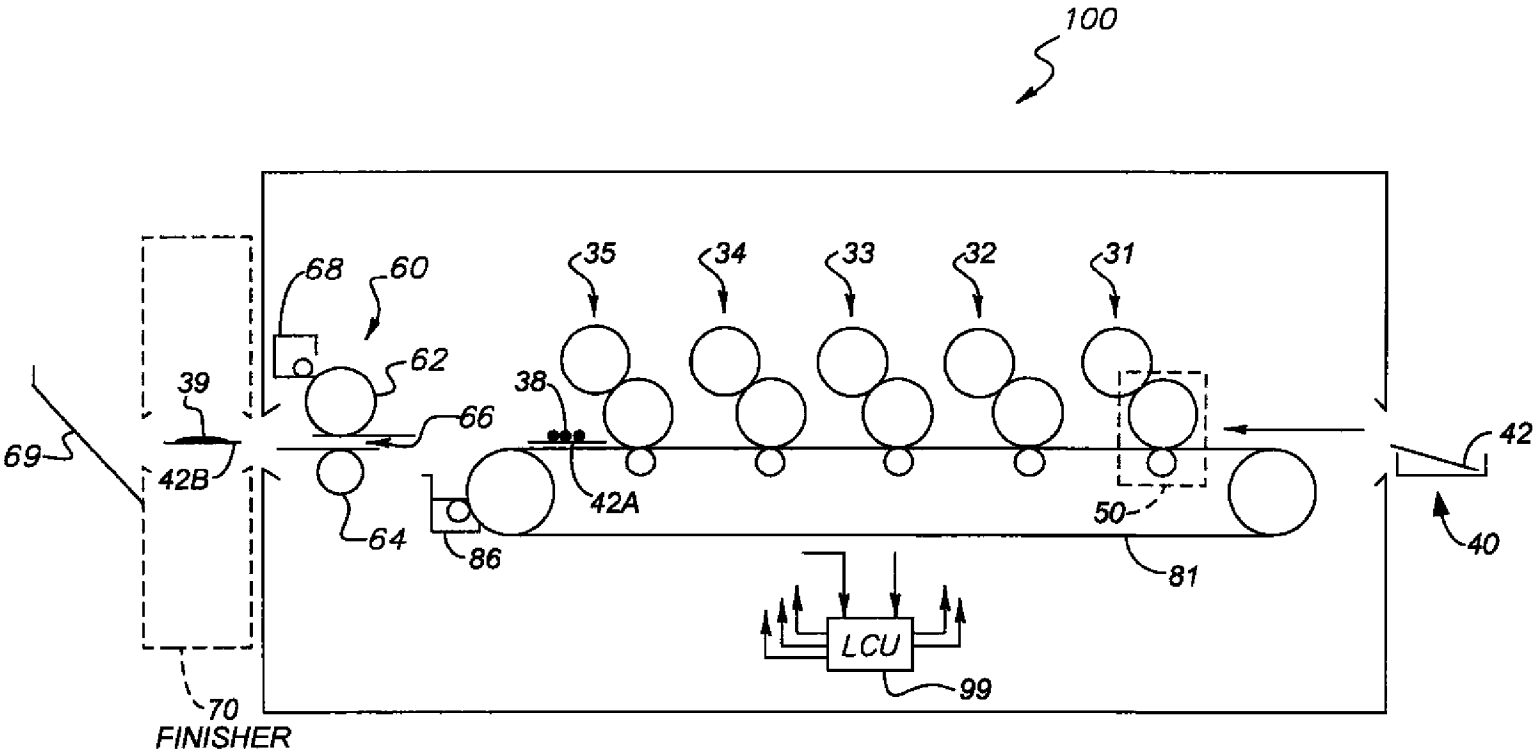
FIG. 1 is an elevational cross-section of an electrophotographic reproduction apparatus suitable for use with this invention.

The attached drawings are for purposes of illustration and are not necessarily to scale.

DETAILED DESCRIPTION OF THE INVENTION

As used herein, the terms "parallel" and "perpendicular" have a tolerance of ±10°.

As used herein, "sheet" is a discrete piece of media, such as receiver media for an electrophotographic printer (described below). Sheets have a length and a width. Sheets are folded along fold axes, e.g. positioned in the center of the sheet in the length dimension, and extending the full width of the sheet. The folded sheet contains two "leaves," each leaf being that portion of the sheet on one side of the fold axis. The two sides of each leaf are referred to as "pages." "Face" refers to one side of the sheet, whether before or after folding.

In the following description, some embodiments of the present invention will be described in terms that would ordinarily be implemented as software programs. Those skilled in the art will readily recognize that the equivalent of such software can also be constructed in hardware. Because image manipulation algorithms and systems are well known, the present description will be directed in particular to algorithms and systems forming part of, or cooperating more directly with, the method in accordance with the present invention. Other aspects of such algorithms and systems, and hardware or software for producing and otherwise processing the image signals involved therewith, not specifically shown or described herein, are selected from such systems, algorithms, components, and elements known in the art. Given the system as described according to the invention in the following, software not specifically shown, suggested, or described herein that is useful for implementation of the invention is conventional and within the ordinary skill in such arts.

A computer program product can include one or more storage media, for example; magnetic storage media such as magnetic disk (such as a floppy disk) or magnetic tape; optical storage media such as optical disk, optical tape, or machine readable bar code; solid-state electronic storage devices such as random access memory (RAM), or read-only memory (ROM); or any other physical device or media employed to store a computer program having instructions for controlling one or more computers to practice the method according to the present invention.

As used herein, "toner particles" are particles of one or more material(s) that are transferred by an EP printer to a receiver to produce a desired effect or structure (e.g. a print image, texture, pattern, or coating) on the receiver. Toner particles can be ground from larger solids, or chemically prepared (e.g.

precipitated from a solution of a pigment and a dispersant using an organic solvent), as is known in the art. Toner particles can have a range of diameters, e.g. less than 8 μm, on the order of 10-15 μm, up to approximately 30 μm, or larger ("diameter" refers to the volume-weighted median diameter, as determined by a device such as a Coulter Multisizer).

"Toner" refers to a material or mixture that contains toner particles, and that can form an image, pattern, or coating when deposited on an imaging member including a photoreceptor, a photoconductor, or an electrostatically-charged or magnetic surface. Toner can be transferred from the imaging member to a receiver. Toner is also referred to in the art as marking particles, dry ink, or developer, but note that herein "developer" is used differently, as described below. Toner can be a dry mixture of particles or a suspension of particles in a liquid toner base.

Toner includes toner particles and can include other particles. Any of the particles in toner can be of various types and have various properties. Such properties can include absorption of incident electromagnetic radiation (e.g. particles containing colorants such as dyes or pigments), absorption of moisture or gasses (e.g. desiccants or getters), suppression of bacterial growth (e.g. biocides, particularly useful in liquid-toner systems), adhesion to the receiver (e.g. binders), electrical conductivity or low magnetic reluctance (e.g. metal particles), electrical resistivity, texture, gloss, magnetic remnance, florescence, resistance to etchants, and other properties of additives known in the art.

In single-component or monocomponent development systems, "developer" refers to toner alone. In these systems, none, some, or all of the particles in the toner can themselves be magnetic. However, developer in a monocomponent system does not include magnetic carrier particles. In dual-component, two-component, or multi-component development systems, "developer" refers to a mixture including toner particles and magnetic carrier particles, which can be electrically-conductive or -non-conductive. Toner particles can be magnetic or non-magnetic. The carrier particles can be larger than the toner particles, e.g. 15-20 μm or 20-300 μm in diameter. A magnetic field is used to move the developer in these systems by exerting a force on the magnetic carrier particles. The developer is moved into proximity with an imaging member or transfer member by the magnetic field, and the toner or toner particles in the developer are transferred from the developer to the member by an electric field, as will be described further below. The magnetic carrier particles are not intentionally deposited on the member by action of the electric field; only the toner is intentionally deposited. However, magnetic carrier particles, and other particles in the toner or developer, can be unintentionally transferred to an imaging member. Developer can include other additives known in the art, such as those listed above for toner. Toner and carrier particles can be substantially spherical or non-spherical.

The electrophotographic process can be embodied in devices including printers, copiers, scanners, and facsimiles, and analog or digital devices, all of which are referred to herein as "printers." Various aspects of the present invention are useful with electrostatographic printers such as electrophotographic printers that employ toner developed on an electrophotographic receiver, and ionographic printers and copiers that do not rely upon an electrophotographic receiver. Electrophotography and ionography are types of electrostatography (printing using electrostatic fields), which is a subset of electrography (printing using electric fields).

A digital reproduction printing system ("printer") typically includes a digital front-end processor (DFE), a print engine (also referred to in the art as a "marking engine") for applying toner to the receiver, and one or more post-printing finishing system(s) (e.g. a UV coating system, a glosser system, or a laminator system). A printer can reproduce pleasing black-and-white or color onto a receiver. A printer can also produce selected patterns of toner on a receiver, which patterns (e.g. surface textures) do not correspond directly to a visible image. The DFE receives input electronic files (such as Postscript command files) composed of images from other input devices (e.g., a scanner, a digital camera). The DFE can include various function processors, e.g. a raster image processor (RIP), image positioning processor, image manipulation processor, color processor, or image storage processor. The DFE rasterizes input electronic files into image bitmaps for the print engine to print. In some embodiments, the DFE permits a human operator to set up parameters such as layout, font, color, paper type, or post-finishing options. The print engine takes the rasterized image bitmap from the DFE and renders the bitmap into a form that can control the printing process from the exposure device to transferring the print image onto the receiver. The finishing system applies features such as protection, glossing, or binding to the prints. The finishing system can be implemented as an integral component of a printer, or as a separate machine through which prints are fed after they are printed.

The printer can also include a color management system which captures the characteristics of the image printing process implemented in the print engine (e.g. the electrophotographic process) to provide known, consistent color reproduction characteristics. The color management system can also provide known color reproduction for different inputs (e.g. digital camera images or film images).

In an embodiment of an electrophotographic modular printing machine useful with the present invention, e.g. the NEXPRESS 2100 printer manufactured by Eastman Kodak Company of Rochester, N.Y., color-toner print images are made in a plurality of color imaging modules arranged in tandem, and the print images are successively electrostatically transferred to a receiver adhered to a transport web moving through the modules. Colored toners include colorants, e.g. dyes or pigments, which absorb specific wavelengths of visible light. Commercial machines of this type typically employ intermediate transfer members in the respective modules for transferring visible images from the photoreceptor and transferring print images to the receiver. In other electrophotographic printers, each visible image is directly transferred to a receiver to form the corresponding print image.

Electrophotographic printers having the capability to also deposit clear toner using an additional imaging module are also known. The provision of a clear-toner overcoat to a color print is desirable for providing protection of the print from fingerprints and reducing certain visual artifacts. Clear toner uses particles that are similar to the toner particles of the color development stations but without colored material (e.g. dye or pigment) incorporated into the toner particles. However, a clear-toner overcoat can add cost and reduce color gamut of the print; thus, it is desirable to provide for operator/user selection to determine whether or not a clear-toner overcoat will be applied to the entire print. A uniform layer of clear toner can be provided. A layer that varies inversely according to heights of the toner stacks can also be used to establish level toner stack heights. The respective color toners are deposited one upon the other at respective locations on the receiver and the height of a respective color toner stack is the sum of the toner heights of each respective color. Uniform stack height provides the print with a more even or uniform gloss.

FIG. 1 is an elevational cross-sections showing portions of a typical electrophotographic printer 100 useful with the present invention. Printer 100 is adapted to produce images, such as single-color (monochrome), CMYK, or pentachrome (five-color) images, on a receiver (multicolor images are also known as "multi-component" images). Images can include text, graphics, photos, and other types of visual content. One embodiment of the invention involves printing using an electrophotographic print engine having five sets of single-color image-producing or -printing stations or modules arranged in tandem, but more or less than five colors can be combined on a single receiver. Other electrophotographic writers or printer apparatus can also be included. Various components of printer 100 are shown as rollers; other configurations are also possible, including belts.

Referring to FIG. 1, printer 100 is an electrophotographic printing apparatus having a number of tandemly-arranged electrophotographic image-forming printing modules 31, 32, 33, 34, 35, also known as electrophotographic imaging subsystems. Each printing module produces a single-color toner image for transfer using a respective transfer subsystem 50 (for clarity, only one is labeled) to a receiver 42 successively moved through the modules. Receiver 42 is transported from supply unit 40, which can include active feeding subsystems as known in the art, into printer 100. In various embodiments, the visible image can be transferred directly from an imaging roller to a receiver, or from an imaging roller to one or more transfer roller(s) or belt(s) in sequence in transfer subsystem 50, and thence to receiver 42. Receiver 42 is, for example, a selected section of a web of, or a cut sheet of, planar media such as paper or transparency film.

Each receiver, during a single pass through the five modules, can have transferred in registration thereto up to five single-color toner images to form a pentachrome image. As used herein, the term "pentachrome" implies that in a print image, combinations of various of the five colors are combined to form other colors on the receiver at various locations on the receiver, and that all five colors participate to form process colors in at least some of the subsets. That is, each of the five colors of toner can be combined with toner of one or more of the other colors at a particular location on the receiver to form a color different than the colors of the toners combined at that location. In an embodiment, printing module 31 forms black (K) print images, 32 forms yellow (Y) print images, 33 forms magenta (M) print images, and 34 forms cyan (C) print images.

Printing module 35 can form a red, blue, green, or other fifth print image, including an image formed from a clear toner (i.e. one lacking pigment). The four subtractive primary colors, cyan, magenta, yellow, and black, can be combined in various combinations of subsets thereof to form a representative spectrum of colors. The color gamut or range of a printer is dependent upon the materials used and process used for forming the colors. The fifth color can therefore be added to improve the color gamut. In addition to adding to the color gamut, the fifth color can also be a specialty color toner or spot color, such as for making proprietary logos or colors that cannot be produced with only CMYK colors (e.g. metallic, fluorescent, or pearlescent colors), or a clear toner or tinted toner. Tinted toners absorb less light than they transmit, but do contain pigments or dyes that move the hue of light passing through them towards the hue of the tint. For example, a blue-tinted toner coated on white paper will cause the white paper to appear light blue when viewed under white light, and will cause yellows printed under the blue-tinted toner to appear slightly greenish under white light.

Receiver 42A is shown after passing through printing module 35. Print image 38 on receiver 42A includes unfused toner particles.

Subsequent to transfer of the respective print images, overlaid in registration, one from each of the respective printing modules 31, 32, 33, 34, 35, receiver 42A is advanced to a fuser 60, i.e. a fusing or fixing assembly, to fuse print image 38 to receiver 42A. Transport web 81 transports the print-image-carrying receivers to fuser 60, which fixes the toner particles to the respective receivers by the application of heat and pressure. The receivers are serially de-tacked from transport web 81 to permit them to feed cleanly into fuser 60. Transport web 81 is then reconditioned for reuse at cleaning station 86 by cleaning and neutralizing the charges on the opposed surfaces of the transport web 81. A mechanical cleaning station (not shown) for scraping or vacuuming toner off transport web 81 can also be used independently or with cleaning station 86. The mechanical cleaning station can be disposed along transport web 81 before or after cleaning station 86 in the direction of rotation of transport web 81.

Fuser 60 includes a heated fusing roller 62 and an opposing pressure roller 64 that form a fusing nip 66 therebetween. In an embodiment, fuser 60 also includes a release fluid application substation 68 that applies release fluid, e.g. silicone oil, to fusing roller 62. Alternatively, wax-containing toner can be used without applying release fluid to fusing roller 62. Other embodiments of fusers, both contact and non-contact, can be employed with the present invention. For example, solvent fixing uses solvents to soften the toner particles so they bond with the receiver. Photoflash fusing uses short bursts of high-frequency electromagnetic radiation (e.g. ultraviolet light) to melt the toner. Radiant fixing uses lower-frequency electromagnetic radiation (e.g. infrared light) to more slowly melt the toner. Microwave fixing uses electromagnetic radiation in the microwave range to heat the receivers (primarily), thereby causing the toner particles to melt by heat conduction, so that the toner is fixed to the receiver.

The receivers (e.g., receiver 42B) carrying the fused image (e.g., fused image 39) are transported in a series from the fuser 60 along a path either to a remote output tray 69, or back to printing modules 31, 32, 33, 34, 35 to create an image on the backside of the receiver, i.e. to form a duplex print. Receivers can also be transported to any suitable output accessory. For example, an auxiliary fuser or glossing assembly can provide a clear-toner overcoat. Printer 100 can also include multiple fusers 60 to support applications such as overprinting, as known in the art.

In various embodiments, between fuser 60 and output tray 69, receiver 42B passes through finisher 70. Finisher 70 performs various paper-handling operations, such as folding, stapling, saddle-stitching, collating, and binding.

Printer 100 includes main printer apparatus logic and control unit (LCU) 99, which receives input signals from the various sensors associated with printer 100 and sends control signals to the components of printer 100. LCU 99 can include a microprocessor incorporating suitable look-up tables and control software executable by the LCU 99. It can also include a field-programmable gate array (FPGA), programmable logic device (PLD), microcontroller, or other digital control system. LCU 99 can include memory for storing control software and data. Sensors associated with the fusing assembly provide appropriate signals to the LCU 99. In response to the sensors, the LCU 99 issues command and control signals that adjust the heat or pressure within fusing nip 66 and other operating parameters of fuser 60 for receivers. This permits printer 100 to print on receivers of various thicknesses and surface finishes, such as glossy or matte.

Image data for writing by printer 100 can be processed by a raster image processor (RIP; not shown), which can include a color separation screen generator or generators. The output of the RIP can be stored in frame or line buffers for transmission of the color separation print data to each of respective LED writers, e.g. for black (K), yellow (Y), magenta (M), cyan (C), and red (R), respectively. The RIP or color separation screen generator can be a part of printer 100 or remote therefrom. Image data processed by the RIP can be obtained from a color document scanner or a digital camera or produced by a computer or from a memory or network which typically includes image data representing a continuous image that needs to be reprocessed into halftone image data in order to be adequately represented by the printer. The RIP can perform image processing processes, e.g. color correction, in order to obtain the desired color print. Color image data is separated into the respective colors and converted by the RIP to halftone dot image data in the respective color using matrices, which comprise desired screen angles (measured counterclockwise from rightward, the +X direction) and screen rulings. The RIP can be a suitably-programmed computer or logic device and is adapted to employ stored or computed matrices and templates for processing separated color image data into rendered image data in the form of halftone information suitable for printing. These matrices can include a screen pattern memory (SPM).

Further details regarding printer 100 are provided in U.S. Pat. No. 6,608,641, issued on Aug. 19, 2003, to Peter S. Alexandrovich et al., and in U.S. Pat. No. 7,502,582, issued Mar. 10, 2009, to Yee S. Ng et al., the disclosures of which are incorporated herein by reference.

As used herein, toner includes at least 50% by weight of polymeric molecules. Polymeric molecules are randomly-coiled (in an un-perturbed state) chains of segments. Each segment contains one or more monomers (molecules). Different segments in a polymeric molecule can include the same monomers (homogeneous polymers) or different monomers (heterogeneous polymers). For example, a single strand of DNA is a heterogeneous polymer including different bases. In various embodiments, polyester or a copolymer of styrene (molecular weight 100) is used as the polymer, as discussed further below. In various embodiments, the average molecular weight of polymeric molecules in the toner is >20,000, or $>1\times10^5$, or not greater than $1\times10^6$. In an embodiment, the average repeat unit count of polymeric molecules in the toner is >100. When above their glass transition temperature $T_g$, these polymer chains or portions thereof can be stretched or extended. If the polymers are quenched, i.e., cooled quickly to below $T_g$, while the chains are extended, the chains will be frozen extended and will carry potential energy that will be released to contract the chains back into a coiled configuration when the temperature is next raised above $T_g$. In an embodiment, higher-molecular-weight (HMW) polymers are used instead of lower-molecular-weight (LMW) polymers. Polymers can recover (that is, lose extension) while being quenched but before their temperatures fall below $T_g$. HMW polymers, however, recover more slowly than LMW polymers. HMW polymers therefore retain more of the potential energy of extension than LMW polymers.

These extended and frozen polymers now provide a heat-shrink effect: when heated above $T_g$, their physical size is reduced along the direction in which the chains are extended. If a large number of polymer chains are extended in the same or substantially the same direction (e.g. within ±30° of each other), a quenched polymer mass (here, a toner film) will be formed that shrinks noticeably along the direction of extension when the temperature is raised above $T_g$. This effect, together with the adhesion of glassy or plastic toner to the receiver on which it is deposited, is used herein to bend paper in desired areas. HMW polymers store more energy, so provide a stronger bending force, than LMW polymers.

Useful amorphous polymers generally have a glass transition temperature ($T_g$) from 50° C. to 100° C. Preferably, toner particles prepared from these polymers have relatively high caking temperature, for example, higher than about 50° C., so that the toner powders can be stored for relatively long periods of time at fairly high temperatures without having individual particles agglomerate and clump together.

Useful binder polymers include vinyl polymers, such as homopolymers and copolymers of styrene. Styrene polymers include those containing 40 to 100 percent by weight of styrene, or styrene homologs, and from 0 to 40 percent by weight of one or more lower alkyl acrylates or methacrylates. Other examples include fusible styrene-acrylic copolymers that are covalently lightly crosslinked with a divinyl compound such as divinylbenzene. Preferred binders comprise styrene and an alkyl acrylate or methacrylate, and the styrene content of the binder is preferably at least about 60% by weight.

Copolymers rich in styrene such as styrene butylacrylate and styrene butadiene are also useful as binders as are blends of polymers. In such blends, the ratio of styrene butylacrylate to styrene butadiene can be 10:1 to 1:10. Ratios of 5:1 to 1:5 and 7:3 are particularly useful. Polymers of styrene butylacrylate or butylmethacrylate (30 to 80% styrene) and styrene butadiene (30 to 90% styrene) are also useful binders. A useful binder can also be formed from a copolymer of a vinyl aromatic monomer; a second monomer selected from either conjugated diene monomers or acrylate monomers such as alkyl acrylate and alkyl methacrylate.

Styrene polymers include styrene, alpha-methylstyrene, para-chlorostyrene, and vinyl toluene; and alkyl acrylates or methylacrylates or monocarboxylic acids having a double bond selected from acrylic acid, methyl acrylate, 2-ethylhexyl acrylate, 2-ethylhexyl methacrylate, ethyl acrylate, butyl acrylate, dodecyl acrylate, octyl acrylate, phenylacrylate, methylacrylic acid, ethyl methacrylate, butyl methacrylate and octyl methacrylate and are also useful binders. Also useful are condensation polymers such as polyesters and copolyesters of aromatic dicarboxylic acids with one or more aliphatic diols, such as polyesters of isophthalic or terephthalic acid with diols such as ethylene glycol, cyclohexane dimethanol, and bisphenols.

Typical useful toner polymers include certain polycarbonates such as those described in U.S. Pat. No. 3,694,359, which include polycarbonate materials containing an alkylidene diarylene moiety in a recurring unit and having from 1 to about 10 carbon atoms in the alkyl moiety. Other useful polymers having the above-described physical properties include polymeric esters of acrylic and methacrylic acid such as poly(alkyl acrylate), and poly(alkyl methacrylate) wherein the alkyl moiety can contain from 1 to about 10 carbon atoms.

Additionally, other polyesters having the aforementioned physical properties are also useful. Among such other useful polyesters are copolyesters prepared from terephthalic acid (including substituted terephthalic acid), a bis[(hydroxyalkoxy)phenyl]alkane having from 1 to 4 carbon atoms in the alkoxy radical and from 1 to 10 carbon atoms in the alkane moiety (which can also be a halogen-substituted alkane), and an alkylene glycol having from 1 to 4 carbon atoms in the alkylene moiety.

Typically, the amount of toner resin present in the toner formulation is greater than 50% but more optionally from about 75 to about 90. Various kinds of well-known addenda (e.g., colorants and release agents) can also be incorporated into the toners of the invention.

A charge control agent can be present in the toner formulations of the present invention. The term "charge-control" refers to a propensity of a toner addendum to modify the triboelectric charging properties of the resulting toner. Preferably, the charge control agent is capable of providing a charge. A preferred consistent level of charge is from about −30 to about −60 μC/gm for an 8 micron volume average median particle size toner.

A very wide variety of charge control agents for positive and negative charging toners are available. Suitable charge control agents are disclosed, for example, in U.S. Pat. Nos. 3,893,935; 4,079,014; 4,323,634; 4,394,430; and British Patent Nos. 1,501,065 and 1,420,839, all of which are incorporated in their entireties by reference herein. Additional charge control agents, which are useful, are described in U.S. Pat. Nos. 4,624,907; 4,814,250; 4,840,864; 4,834,920; 4,683,188; and 4,780,553, all of which are incorporated in their entireties by reference herein. Mixtures of charge control agents can also be used. Particular examples of charge control agents include chromium salicylate organo-complex salts, and azo-iron complex-salts, an azo-iron complex-salt, particularly ferrate (1-), bis[4-[(5-chloro-2-hydroxyphenyl) azo]-3-hydroxy-N-phenyl-2-naphthalenecarboxamidato (2-)], ammonium, sodium, and hydrogen (Organoiron available from Hodogaya Chemical Company Ltd.).

Further details of toner chemistry and preparation can be found in U.S. Publication No. 2010/0015421 by Tyagi et al., the disclosure of which is incorporated herein by reference.

Figure 2:
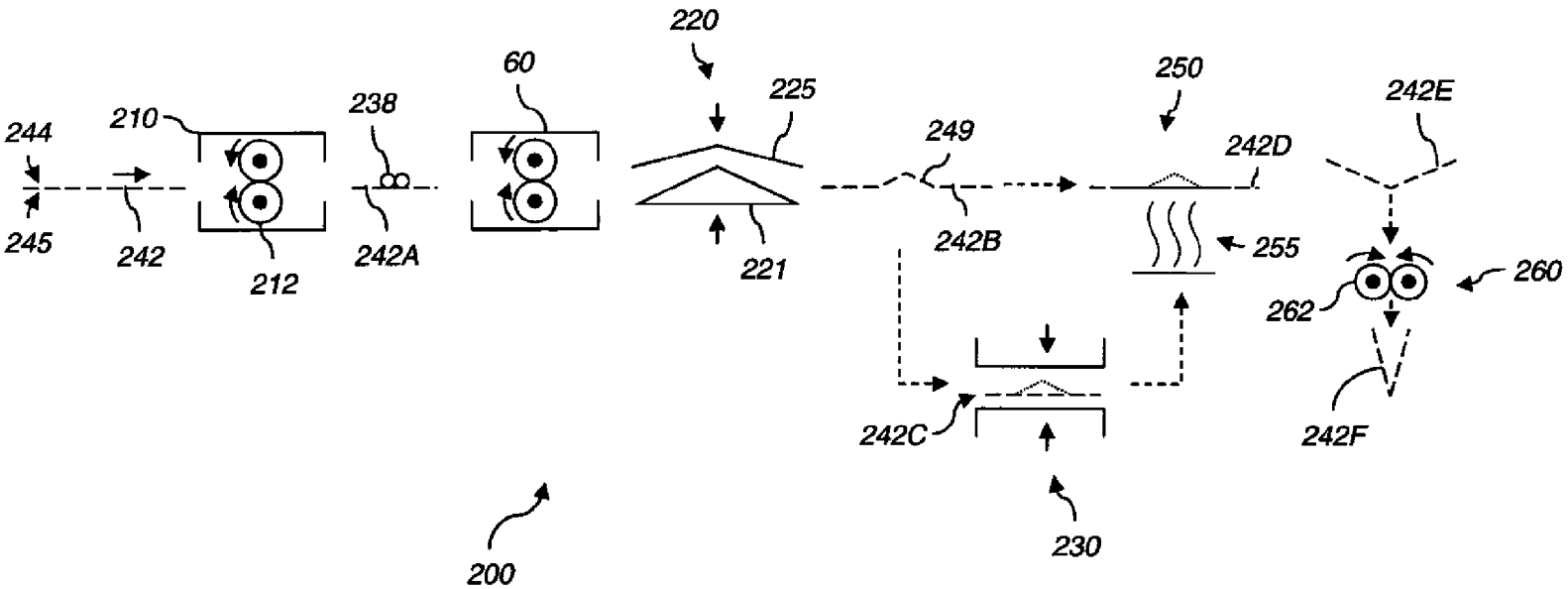
FIG. 2 is a schematic of apparatus according to an embodiment of the present invention.

FIG. 2 shows the main functional components of apparatus 200 for bending receiver 242, and the state of receiver 242 at various points in the processing performed by apparatus 200. For clarity, receivers are shown in lines with long dashes, and pieces of equipment are shown in solid lines. The components shown in FIG. 2 are not shown to scale. Receiver 242 has image side 244 and non-image side 245, and a bend area discussed further below with respect to FIG. 3.

Electrophotographic print engine 210 deposits toner on image side 244 of receiver 242 in the bend area. Print engine 210 can include rollers 212, as described above with respect to FIG. 1, e.g., a transfer roller and a backup roller.

After the toner is deposited, the receiver travels through fuser 60 (as shown in FIG. 1). Fuser 60 heats the toner on the receiver to a temperature above its glass transition temperature $T_g$. This fuses the image toner to the receiver, and fuses or tacks the deposited toner in the bend areas to the receiver. In various embodiments, fuser 60 is a non-contact fuser with a directed radiation pattern, e.g., an IR, photoflash, or microwave fuser; or a contact fuser such as a heated-roller or heated-platen fuser. In various embodiments, hot air is blown across the image toner. In various embodiments, the receiver is placed on a selectively-heated platen to fuse the toner.

Compressing device 220 receives receiver 242A having deposited toner 238 tacked to the receiver, and optionally image toner fused to the receiver. Compressing device 220 compresses deposited toner 238 in the bend area to form a toner film. The toner film is a thin layer of toner on the surface of the receiver. The toner film does not have to be continuous; it can have voids or tears. The toner film can be uniform in thickness, or thicker at the edges than in the center.

Compressing device 220 includes anvil 221 and quencher 225, as will be discussed further below with respect to FIG. 3.

In various embodiments, compressing device 220 does not disturb the image toner. Only deposited toner in the bend area is compressed, so that compressing device 220 does not reduce the image quality of the visible image made from the unfused image toner.

The result of fusing and compressing is receiver 242B, which can have bump 249. In various embodiments, bump 249 is the result of compressing the bend area of the receiver. In various embodiments, flattener 230 flattens receiver 242C after compression and before post-heating, as will be discussed further below. Finishing operations, e.g., trimming and chopping, can be performed after flattening.

Heater 250 selectively reheats the bend area of receiver 242D so that temperature of the toner in the bend area rises above its $T_g$, either quickly or slowly. This causes the toner to contract, bending the receiver at or in close proximity (e.g., within 5 mm, 2 mm, or 1 mm) to the bend axis. Non-contact or other selectively-operable fusers, as described above, can be employed as heating elements 255 (represented graphically).

The result of heating toner in the bend area is bent receiver 242E. In various embodiments, folding unit 260 is used to fold the bent receiver more crisply. Folding unit 260 can include a pair of pinch rollers 262, shown here, or a grip-and-fold mechanism, buckle folder, or other type of folder known in the art. Folding unit 260 can also include two plates to press the opposite sides of the bend together, or a pinch roller running along the spine of receiver 242E. The result of folding is folded receiver 242F.

In various embodiments, toner is deposited and compressed on image side 244 and non-image side 245 successively. This can be used to bend different bend axes in different directions, e.g., to produce a "Z" fold. Each side is processed individually and as described above. An inverter inverts receiver 242 and passing it back through print engine 210 and subsequent components. In an alternative embodiment, two compressing devices 220 are provided. One compressing device 220 has anvil 221 disposed adjacent to non-image side 245, as shown in FIG. 2, and the other compressing device (not shown) is inverted so that anvil 221 is disposed adjacent to image side 244 and quencher 225 is disposed adjacent to non-image side 245. In this embodiment, toner can be deposited on bend areas on both sides of receiver 242 in a single pass using two print engines 210. Image toner can be deposited on image side 244 but not on non-image side 245.

In various embodiments, multiple compressing devices 220 are arranged around the circumference of a drum. Two drums disposed on opposite sides of receiver 242A from each other can be used. Each drum has one or more anvils 221, or one or more quenchers 225, arranged around its circumference. The drums have corresponding parts; where one has an anvil, the other has a quencher. Receivers can pass through these drums while the drums continuously rotate, thereby stretching toner in an efficient manner. Alternatively, a single drum can be used with one or more selectively-engaged anvils or drums. For example, a drum can have a plurality of anvils arranged around its circumference, and a quencher mounted on a piston and disposed on the opposite side of the receiver from the drum can engage the receiver against each successive anvil on the drum as the drum turns.

Figure 3:
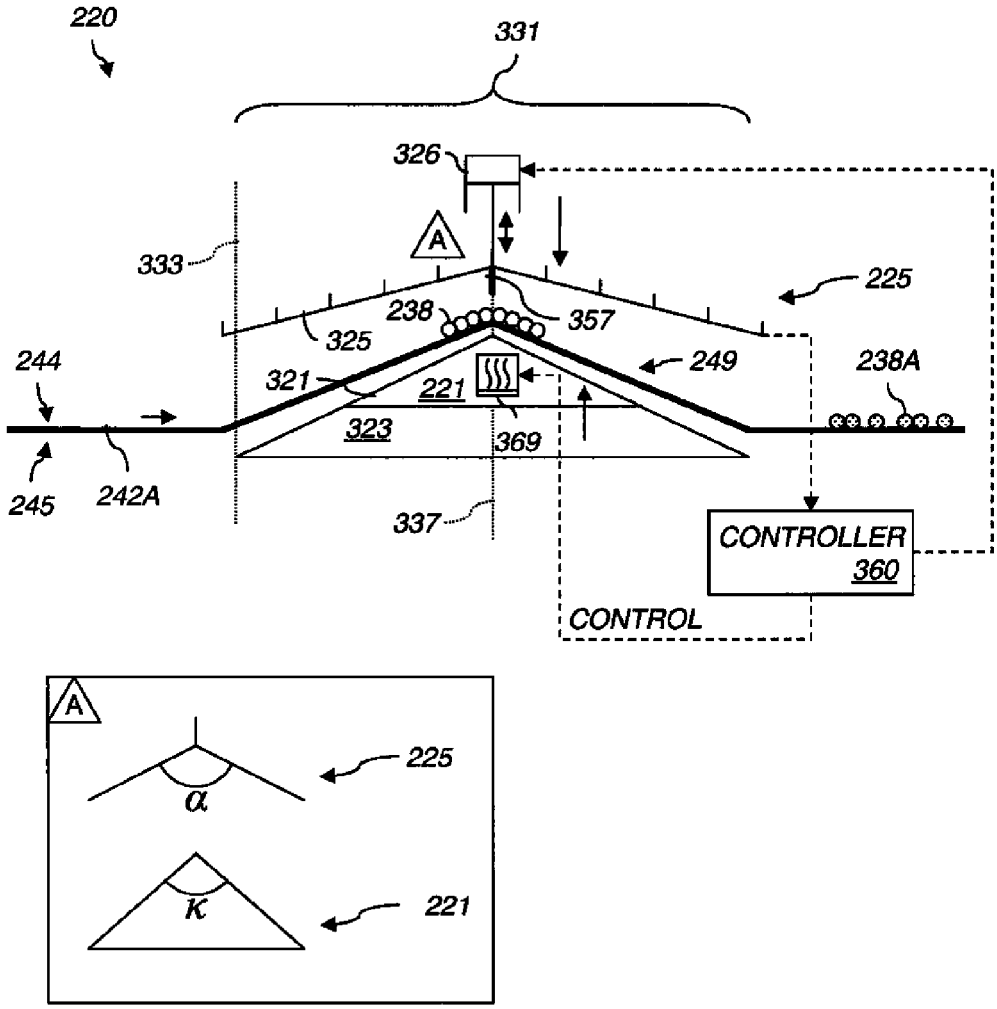
FIG. 3 is an elevational cross-section showing detail of a portion of FIG. 3.

FIG. 3 shows detail of compressing device 220. Receiver 242A includes bend area 331 in which receiver 242A will be bent by the toner 238 when toner 238 is reheated by heater 250 (FIG. 2) after compression. In various embodiments, bend area 331 ranges from 2 mm to 5 mm wide. Bend area 331 includes bend axis 337 which is the main locus of bending. However, it is not required that the bend be a sharp fold located precisely at bend axis 337. In various embodiments, bends can range in radius of curvature from 0.1 mm to 1 mm, or as large as 1 m. In various embodiments, receiver 242A includes a plurality of bend areas, each of which is as described herein for bend area 337. Bend areas do not have to be straight lines; bend axis 337 can be a curve to describe a curved bend. An example of such a curve is the bottom of a French-fry carton, shown in U.S. Pat. No. 6,053,403 to Liming (for the BURGER KING FRYPOD), the disclosure of which is incorporated herein by reference. In another embodiment, large bend radii (e.g., radii >1 in) are used to provide a gentle curve, so that receiver 242E approximates a portion of the curved surface of a cylinder. In this embodiment, multiple parallel bend axis 337 are provided on receiver 242.

Electrophotographic print engine 210 (FIG. 2) deposits toner on image side 244 of receiver 242A in bend area 331. In various embodiments, toner laydown ranges from 0.45 $mg/cm^2$ to 5.0 $mg/cm^2$, preferably from 1-3 $mg/cm^2$. Particles of toner 238 can have diameters >8 μm. Laydown thickness before quenching can range from 5-50 μm. The actual or peak (e.g., 320% or 400%) laydown thickness of toner in bend area 331 can be greater than the actual or peak laydown thickness of image toner outside bend area 331.

Anvil 221 is disposed adjacent to non-image side 245 of receiver 242A. Anvil 221 is selectively heated, so that the temperature of the toner 238 in bend area 331 rises above its $T_g$. This causes toner 238 to transition from a glassy to a plastic state, in which the mass of toner 238 can be reshaped.

Quencher 225 is disposed adjacent to image side 244 of receiver 242A, opposite anvil 221. After the temperature of toner 238 in bend area 331 rises above its $T_g$, quencher 225 selectively presses bend area 331 of receiver 242A, and toner 238 therein, against anvil 221. Toner 238 in bend area 331 is therefore stretched by mechanical compression into a thinner, broader mass. Furthermore, quencher 225 is cooled before or while pressing against the anvil. Therefore, as quencher 255 presses on toner 238, toner 238 in bend area 331 is cooled below its $T_g$ by the quencher. This causes toner 238 to solidify (i.e., return to a glassy state) with the polymer chains in the particles of toner 238 extended, and the mass of toner 238 pressed thin. In this way, the toner film disposed over the surface of receiver 242A in bend area 331 is formed. The toner film is not required to occupy all of, or be contained entirely within, bend area 331, nor is it required to extend substantially along bend axis 337.

Surface 321 of anvil 221 and surface 325 of quencher 225 are pressed toward each other to form the toner film. These surfaces can be parallel or non-parallel. In an embodiment, the surfaces are closest at bend axis 337 and diverge along their lengths. This provides a thicker toner film farther from the bend axis, advantageously reducing the amount of toner directly at the bend axis 337. Toner at the bend axis 337 has to be compressed to fold receiver 242A; too much toner there will result in a lump of toner in the fold.

In an embodiment, quencher 225 includes scoring blade 357 disposed over or along bend axis 337. Scoring blade 357 scores the receiver while quencher 225 cools toner 238. This advantageously improves the sharpness of the bend by reducing resistance due to the stiffness of the paper. Note that scoring blade 357 is not shown to scale; in practice, it protrudes part way but not all the way through receiver 242A when quencher 225 is fully engaged against anvil 221.

In various embodiments, anvil 221 or quencher 225 includes two faces (for anvil 221, one of them is surface 321) joined at an acute or obtuse angle. Anvil 221 and quencher 225 can have the same or different angles joining their respective faces. A zone of compression with an angle advantageously forces toner 238 more strongly perpendicular to bend axis 337 than parallel to it, unlike a flat anvil and quencher, which would force toner 238 out isotropically.

Specifically, in various embodiments, bend area 331 has edge 333, and the toner film is thicker at or over edge 333 of bend area 331 than at or over bend axis 337. By "over bend axis 337" it is meant that the toner film closer to bend axis 337 is thinner than the toner film farther from bend axis 337.

In an embodiment, quencher 225 includes two faces joined at an acute or obtuse angle. Controller 360 determines the thickness of the receiver as discussed below and adjusts the angle between the two faces of the quencher correspondingly.

FIG. 3 detail A (⚠) shows angle $\alpha$ between the two faces of anvil 221 and angle $\kappa$ between the two faces of quencher 225; $\kappa \leqq \alpha$ always. Given a thick paper H and a thin paper N, $\alpha_H-\kappa_H>\alpha_N-\kappa_N$. That is, thicker papers use a large difference between the angles to push more toner farther from bend axis 337. This reduces clumping of toner at bend axis 337 where it can interfere with a fold, and can increase the force applied to bend the receiver.

In an embodiment, quencher 225 presses bend area 331 of receiver 242A against anvil 221 with a selected force. A control unit (not shown) receives a signal indicating the thickness of receiver 242A and automatically adjusts the selected force in response to the received signal. The control unit can be a CPU, PLD, PAL, FPGA, or other logic device. The control unit can be implemented as part of controller 360. The signal can be provided by an automatic micrometer, a sonar sensor, or another thickness sensor known in the art. An example of a contact paper-thickness sensor using an encoder to determine motion of a spring-loaded arm when moved by the receiver is shown in U.S. Pat. No. 7,654,638 to Silverbrook, the disclosure of which is incorporated herein by reference. Quencher 225 can be pressed against anvil 221 by piston 326, which can be operated electrically, hydraulically, or pneumatically, or by another linear actuator, motor, or slide, such as a piezoelectric actuator. Applying a higher force stretches out toner 238 over a greater area, but produces a thinner toner film exerting less force per unit area. A greater mass of toner is preferably used for thicker paper than for thinner paper.

As shown in FIG. 3, in various embodiments, anvil 221 and quencher 225 put a bump 249 in receiver 242A. This bump can be flattened as discussed above after the toner has been quenched (returned to a glassy state) by quencher 225.

In various embodiments, anvil 221 and heater 225 do not heat image toner 238A on receiver 242A outside of bend area 331 above the $T_g$ of toner 23 8A. This advantageously reduces image artifacts due to toner heating.

In various embodiments, compressing device 220 includes non-heated platen 323 disposed opposite receiver 242A from quencher 225. Platen 323 is in mechanical contact with at least one point on anvil 221. Anvil 221 can also be a single unit including a heated tip and a non-heated body (platen 323). This advantageously reduces the thermal mass of the body engaging quencher 225.

In various embodiments, the thermal mass of quencher 225 is greater than the thermal mass of anvil 221. The temperature of quencher 225 is less than both the temperature of toner 238 and the temperature of anvil 221. In this way, quencher 225 absorbs heat from toner 238 and anvil 221 to cool toner 238 below its $T_g$.

In various embodiments, compressing device 200 includes heat supply 369 (represented graphically) for selectively heating anvil 221. Controller 360 monitors the position of quencher 225 and deactivates heat supply 369 when quencher 225 contacts receiver 242A. This advantageously reduces the amount of heat that anvil 221 sinks as toner 238 cools. Heat supply 369 can be a resistive, IR, inductive, or thermoelectric heater; a Stirling or other heat engine sinking heat into anvil 221; a radioisotope thermoelectric generator; a friction heater in which a motor drives a rotating member held in contact with anvil 221 to heat anvil 221 by friction with the rotating member, or another heat source known in the art.

In various embodiments, the mass of toner in the bend area is greater than 0.4 mg/cm$^2$, or less than 200 mg/cm$^2$. This mass of toner provides enough strength to bend receiver 242A without being highly objectionable as too thick. In an embodiment, more than one layer of toner particles is deposited in bend area 331. A 100% layer of 6 μm toner particles provides 0.34 mg/cm$^2$, so two layers can provide 0.68 mg/cm$^2$. In other embodiments, about 2.5 mg/cm$^2$, or at least 5 mg/cm$^2$ of toner are deposited.

A 4 μm height difference is at the threshold of the human touch sensation. A 10 μm height difference is at the threshold of a human tactile sensation. A 25 μm height difference provokes a discernable tactile response in most humans. Braille dots, which are designed to be easy to feel, are at least 100 μm high (about 200 mg/cm$^2$ regardless of particle size). Braille dots are preferably at least 180 μm high. In various embodiments, the toner film is less than 4 μm thick, <10 μm, <25 μm, <100 μm, or <180 μm to provide bending without significant tactile effect.

In various embodiments, the thickness of the toner film reduces by half when it is heated before quenching. Twice as much toner 238 is therefore deposited to obtain the desired thickness and coverage.

The amount of force applied to toner 238 and the closest spacing between anvil 221 and quencher 225 is selected to balance bending force and thickness. Applying more force or pressing anvil 221 and quencher 225 closer together gives a thinner toner film. A thinner film has more area but less bending force per unit area. Applying less force or pressing anvil 221 and quencher 225 not as close together gives a thicker toner film. A thicker film has less area but more bending force per unit area.

The amount of toner 238 applied in bend area 331 is also selected carefully. In various embodiments, more toner is applied to thicker receivers 242A than to thinner receivers 242A.

In various embodiments, the entire receiver is heated. For receivers with multiple bend areas, heating the entire receiver at once will cause bending in some or all bend areas simultaneously. Different toners with different $T_g$ values, or different dimensions of bend area and laydowns of toner, can be used to produce bends in sequence. For example, lower $T_g$ areas will bend before higher-$T_g$ areas as the receiver gradually heats, and higher toner laydown bend areas (higher force per unit area) will bend faster than lower toner laydown bend areas (lower force per unit area).

Figure 4:
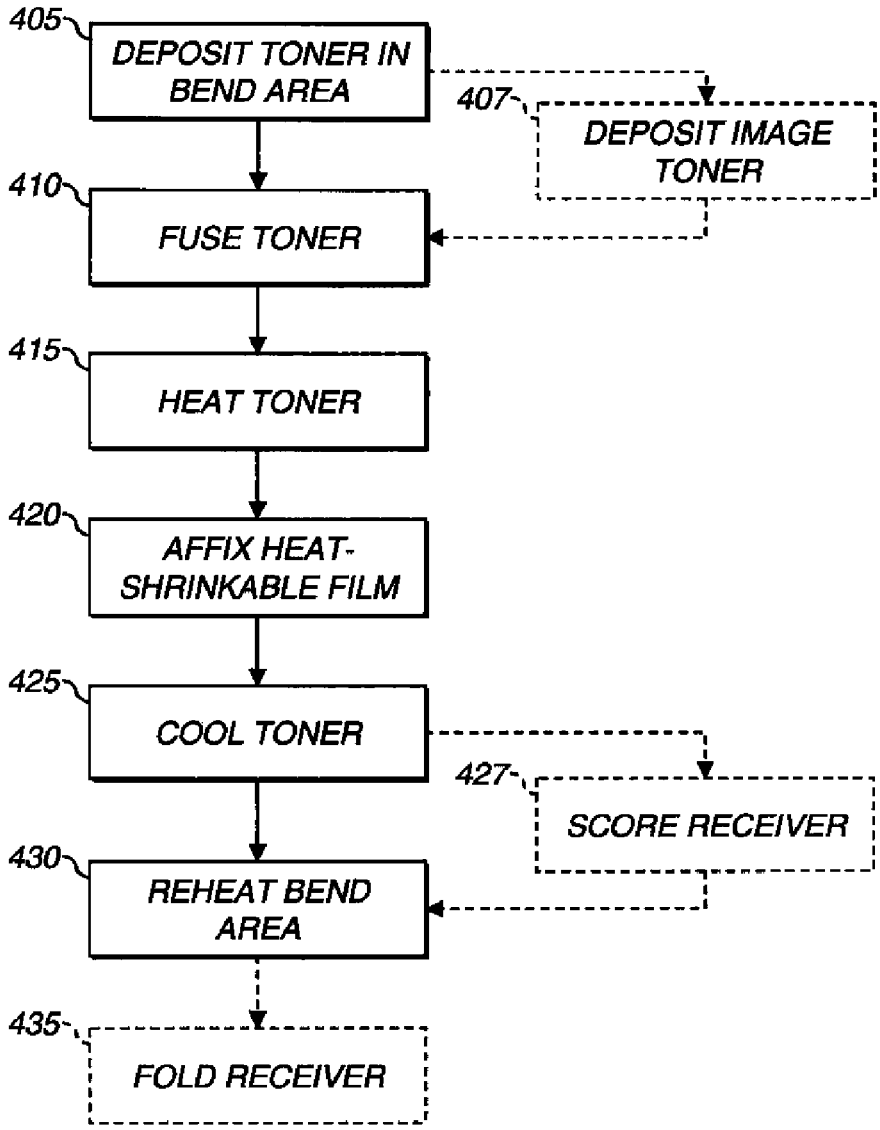
FIG. 4 is a flowchart of a method useful with the present invention.

FIG. 4 shows a method for bending a receiver useful with the present invention. The receiver has an image side and a non-image side, and a bend area including a bend axis 337, as described above. Processing begins with step 405.

In step 405, toner is deposited on the image side of the receiver in the bend area using an electrophotographic print engine. Step 405 is followed by step 410, and optionally by step 407.

In optional step 407, image toner is deposited on the image side of the receiver outside the bend area using the electrophotographic print engine. This is performed before fusing the toner (step 410, below). In embodiments using step 407, the reheating step (step 430, below) does not heat image toner on the receiver outside the bend area to a temperature above the $T_g$ of that toner. Step 407 is followed by step 410.

In step 410, the deposited toner is fused to the receiver. This can be accomplished using a fuser known in the art, as described above. Step 410 is followed by step 415.

In step 415, the toner is heated to a selected fusing temperature greater than or equal to the $T_g$ of the toner. This is performed after fusing (step 410), and optionally during or directly after fusing, while the toner is still liquid or semi-liquid. Any fuser or heater can be used to heat the toner, as described above. Step 415 is followed by step 420.

In step 420, a heat-shrinkable film is affixed to the heated toner. This is performed after heating the toner to the selected fusing temperature. The $T_g$ of the film is greater than the $T_g$ of the toner. The film can be a cut section, sheet, or tape. The dimensions of the tape (including ratios L:W:D) can be selected by one skilled in the art. Step 420 is followed by step 425.

In an embodiment, the $T_g$ of the heat-shrinkable film is greater than the fusing temperature.

Finishing operations, e.g., trimming and chopping, can be performed before or after heating the toner and affixing the heat-shrinkable film.

In step 425, the toner is cooled below its Tg after affixing the film. This can be done naturally by waiting for passive dissipative cooling to occur, or by forced cooling using cold air, a cold plate, a thermoelectric cooler, immersion in a cold liquid, or other ways of chilling known in the art. Step 425 is followed by step 430 and optionally by step 427.

In optional step 427, the non-image side of the receiver is scored along the bend axis before reheating the bend area. By "along" it is meant that the score substantially follows the bend axis. Deviations from the bend axis of up to ±2 mm or ±10% of the width of the bend area are permitted. Step 427 is followed by step 430.

In step 430, the bend area of the receiver is reheated after cooling the toner below its $T_g$. The temperature of the heat-shrinkable film rises above its $T_g$, either quickly or slowly. The heat-shrinkable film therefore contracts. Since the film is held to the receiver by the toner, the receiver bends at or near the bend axis. Step 430 is followed by optional step 435.

In optional step 435, the receiver is automatically folded along the bend axis after reheating. Various types of folders can be used, as described above.

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the "method" or "methods" and the like is not limiting. The word "or" is used in this disclosure in a non-exclusive sense, unless otherwise explicitly noted.

The invention has been described in detail with particular reference to certain preferred embodiments thereof, but it will be understood that variations, combinations, and modifications can be effected by a person of ordinary skill in the art within the spirit and scope of the invention.

PARTS LIST

31, 32, 33, 34, 35 printing module
38 print image
39 fused image
40 supply unit
42, 42A, 42B receiver
50 transfer subsystem
60 fuser
62 fusing roller
64 pressure roller
66 fusing nip
68 release fluid application substation
69 output tray
70 finisher
81 transport web
86 cleaning station
99 logic and control unit (LCU)
100 printer
200 apparatus
210 print engine
212 rollers
220 compressing device
221 anvil
225 quencher
230 flattener
238, 238A toner
242, 242A, 242B, 242C, 242D, 242E, 242F receiver
244 image side
245 non-image side
249 bump
255 heating element
260 folding unit
262 rollers
321 surface
323 platen
325 surface
326 piston
331 bend area
333 edge
337 bend axis
357 scoring blade
360 controller
369 heat supply
405 deposit toner in bend area step
407 deposit image toner step
410 fuse toner step
415 heat toner step
420 affix heat-shrinkable film step
425 cool toner step
427 score receiver step
430 reheat bend area step
435 fold receiver step

The invention claimed is:

1. Apparatus for bending a receiver having an image side and a non-image side in a bend area, the bend area including a bend axis, comprising:

a) an electrophotographic print engine for depositing toner on the image side of the receiver in the bend area;

b) a device for compressing the deposited toner to form a toner film, the compressing device including:

i) a heated anvil disposed adjacent to the non-image side of the receiver, so that the temperature of the toner in the bend area rises above its glass transition temperature; and ii) a quencher disposed adjacent to the image side of the receiver opposite the anvil and operative to selectively press the bend area of the receiver and the toner therein against the anvil after the temperature of the toner in the bend area rises above its glass transition temperature, the quencher being cooled, so that the toner in the bend area is stretched and cooled below its Tg by the quencher to form the toner film disposed over the surface of the receiver in the bend area; and c) a heater for reheating the bend area of the receiver so that temperature of the toner in the bend area rises above its glass transition temperature, so that the toner contracts and the receiver bends at the bend axis.

2. The apparatus according to claim 1, wherein the mass of toner in the bend area is greater than 0.4 mg/cm$^2$.

3. The apparatus according to claim 1, wherein the bend area further includes an edge, and the toner film is thicker over the edge of the bend area than over the bend axis.

4. The apparatus according to claim 1, wherein the quencher further includes a scoring blade disposed over the bend axis, the scoring blade operative to score the receiver while the quencher cools the toner.

5. The apparatus according to claim 1, wherein the anvil includes two faces joined at an acute or obtuse angle.

6. The apparatus according to claim 5, wherein the quencher includes two faces joined at an acute or obtuse angle, further including means for determining the thickness of the receiver and adjusting the angle between the two faces of the quencher.

7. The apparatus according to claim 1, further including means for flattening the receiver after quenching and before post-heating.

8. The apparatus according to claim 1, further including means for providing a fold along the bend axis.

9. The apparatus according to claim 1, wherein the anvil and heater do not heat toner on the receiver outside the bend area to a temperature above the glass transition temperature of that toner.

10. The apparatus according to claim 1, further including a non-heated platen disposed opposite the receiver from the quencher and in contact with at least one point on the anvil.

11. The apparatus according to claim 1, wherein the thermal mass of the quencher is greater than the thermal mass of the anvil and the temperature of the quencher is less than both the temperature of the toner and the temperature of the anvil, so that quencher absorbs heat from the toner and anvil.

12. The apparatus according to claim 1, further including a heat supply for selectively heating the anvil.

13. The apparatus according to claim 12, further including a controller for deactivating the heat supply when the quencher contacts the receiver.

14. The apparatus according to claim 1, further including a fuser for selectively heating toner on the receiver not in the bend area to a temperature above the glass transition temperature of that toner.

15. The apparatus according to claim 1, wherein the quencher presses the bend area of the receiver against the anvil with a selected force, and further including a control unit for receiving a signal indicating the thickness of the receiver and adjusting the selected force in response to the received signal.

16. The apparatus according to claim 1, wherein the toner film is less than 25 μm thick.

* * * * *